United States Patent [19]

Corbett

[11] 4,142,074

[45] Feb. 27, 1979

[54] MICROPHONE

[75] Inventor: Charles K. Corbett, Bethesda, Md.

[73] Assignee: The United States of America as represented by the Attorney General of the United States, Washington, D.C.

[21] Appl. No.: 693,217

[22] Filed: Oct. 29, 1957

[51] Int. Cl.[2] ..... H04R 21/02

[52] U.S. Cl. ..... 179/124

[58] Field of Search ..... 179/122, 127, 131, 138, 179/141, 121, 124, 125, 140

[56] References Cited

U.S. PATENT DOCUMENTS

| | | | |
|---|---|---|---|
| 1,096,677 | 5/1914 | Brown | 179/138 |
| 1,637,243 | 7/1927 | Reisz | 179/181 |
| 2,607,859 | 8/1952 | Bryant | 179/124 |

FOREIGN PATENT DOCUMENTS

| | | | |
|---|---|---|---|
| 153888 | 10/1953 | Australia | 179/125 |

*Primary Examiner*—Howard A. Birmiel
*Attorney, Agent, or Firm*—T. Hayward Brown; H. L. Godfrey; Joseph A. Hill

EXEMPLARY CLAIM

1. A sound actuated device comprising a non-metallic cylindrical case having a closed end provided with a coaxial aperture extending therethrough, a carbon cup having a hemispherical recess with a coaxial aperture extending therethrough, a flexible wire loop, the said carbon cup being affixed within the said case in such manner that the apertures of both cup and case are in alignment with the said wire loop interposed between the abutting surfaces of the cup and the end of the case and disposed about the aperture, a carbon button of curvature complimentary to the recess of the said cup and in fixed aligned suspension therein, a flexible annular retainer concentrically secured to said carbon button and affixed to the radial outer surfaces of said carbon cup to maintain said button in said fixed aligned suspension, a first lead means passing through the said button along the central axis thereof and conductively affixed therein with the terminus thereof beyond the curved surface, carbon granules loosely distributed and contained between the said button, said cup and in the aperture of the said case, a non-metallic cone shaped diaphragm with the apex thereof attached to the center of the said carbon button and a second lead means connected to said wire loop; whereby sound induced vibrations on the diaphragm result in the reciprocal movements of the carbon button which in turn compresses and decompresses the carbon granules, thus inducing a variation of resistance between the first and second lead means.

2 Claims, 2 Drawing Figures

CHARLES K. CORBETT
INVENTOR.
BY T. Hayward Brown
ATTORNEYS.

CHARLES K. CORBETT
*INVENTOR.*

BY T. Hayward Brown
*ATTORNEYS.*

MICROPHONE

The invention described herein may be manufactured and used by or for the Government of the United States for governmental purposes without the payment to me of any royalty thereon in accordance with the provisions of 35 U.S.C. 266.

This invention relates to a granular carbon microphone, and more particularly to a non-metallic microphone for converting sound waves into electrical impulses.

Scouting parties are frequently sent ahead of the front lines, particularly under the cover of darkness, to gather valuable information from the enemy lines and thereby alert the area commander to future plans of the enemy.

Very successful missions, in the past, have been accomplished by concealing microphones near the enemy trenches and "listening in" on conversation during the hours of darkness. However, this method of gaining information was not always successful, due to the fact that metal detectors would readily reveal the presence of the conventional metallic microphones.

One object of the present invention is to eliminate one or more of the disadvantages of the conventional type microphones. Another object of the invention is to provide a microphone which is not detectable to the known metal detectors. A further object of the invention is to provide a microphone which is greatly simplified and inexpensive.

Other and further objects will be apparent to those skilled in the art from the following description.

The foregoing and related objects are accomplished by this invention wherein the metal parts of the heretofore constructed microphones have been eliminated with the exception of the connecting wires.

Referring now to the drawings, in which.

Figure 1:
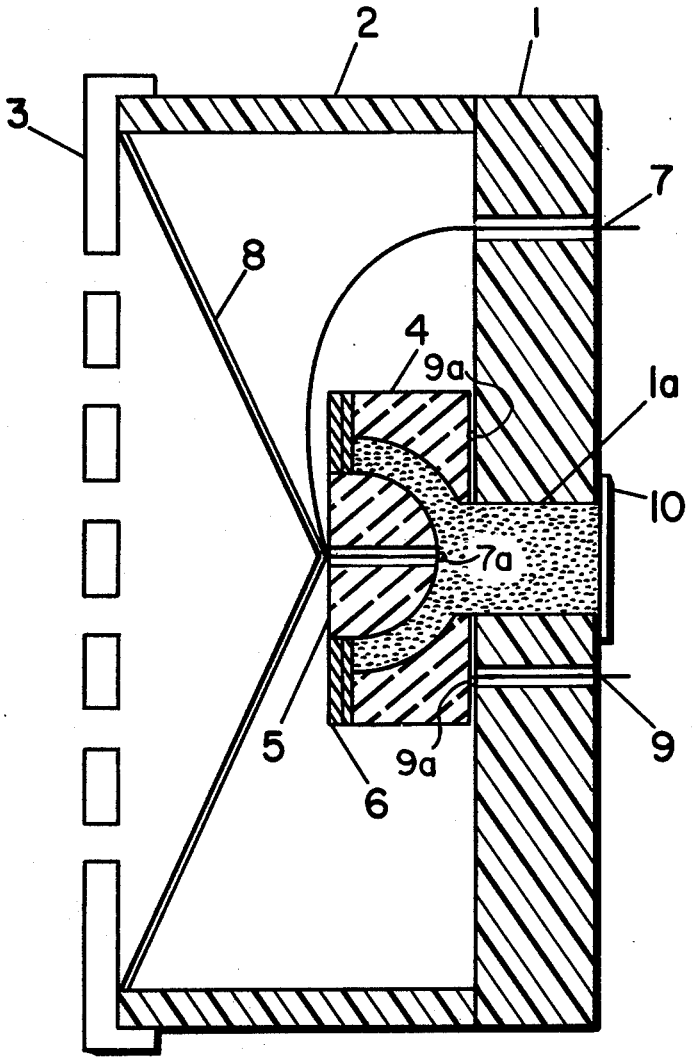
FIG. 1 is a cross-section of an embodiment of the invention using a cone-shaped non-metallic diaphragm.

In FIG. 1, a non-metallic case 1 is provided with a centrally located aperture 1*a*. A carbon cup 4 having a centrally located aperture together with a wire loop 9*a* geometrically positioned about the aperture is is cemented, or otherwise attached, to the case 1 with the two apertures in coincidence. While a central aperture communicating from cup 4 through base 1 is preferred, the position of the aperture is not critical, when the microphone is used in a vertical position.

A carbon button 5, having a diameter across the flat face less than the inside diameter of the cup 4, is centrally mounted on the carbon cup by means of the annular granule retainer 6. That is, the annular granule retainer 6 is cemented or affixed to the surface of cup 4 and also, cemented or affixed to the larger peripheral edge of button 5. The flat surface of button 5 is in alignment with the unattached side of retainer 6. The annular retainer is preferably made of a suitable fabric to permit free movement of the carbon button 5. The space formed between the carbon button and the carbon cup is filled with carbon granules through the aperture 1*a*. The annular granule retainer 6 and the granule retainer 10 contain the carbon granules in the said space.

The central aperture in carbon cup 4, FIG. 1, is centrally located to insure equal and even distribution of carbon granules. If the carbon granules are not equally distributed, response, both frequency and sensitivity, will be affected when the microphone is operated in a position other than vertical. This central aperture provides the distribution facilities to assure ideal frequency response. In addition, this aperture permits changing the carbon granules when they become noisy and/or packed.

A non-metallic cone-shaped diaphragm 8 is cemented or otherwise attached at its peripheral edge to side member 2. The apex of diaphragm 8 together with the flexible lead 7 are cemented to the geometrical center of carbon button 5. The flexible lead 7 is interposed between the apex of diaphragm 8 and the point of attachment on button 5. Also the flexible lead 7 extends beyond the point of juncture through the center of button 5. The terminus of said lead 7 is in the space filled with the carbon granules and is permanently affixed by bead 7*a* to button 5 so as to remain therein notwithstanding the reciprocating movement of button 5 induced by the vibrations of diaphragm 8 during use.

A lead 9 is connected to the wire loop 9*a* embedded in the cemented juncture of cup 4 and base 1. Flexible leads 7 and 9 are utilized to connect the microphone to an external circuit.

Sound waves enter through the apertured diaphragm cover 3, striking the non-metallic diaphragm 8 which with the forward motion of the sound wave applies pressure to the carbon granules. With the rarefaction or backward motion of the sound wave the pressure is released and the carbon granules relax in proportion to the rarefaction of the sound wave. These changes of pressure on the mass of carbon granules cause a variation in the resistance of the carbon mass. A source of direct current is applied to a series circuit (not shown) consisting of the carbon button lead, primary winding of a coil or transformer and the carbon cup lead. As sound waves cause a change in the resistance of the mass of carbon granules, a change in the current flow in the circuit results. Suitable amplifiers, coils, etc., may be used to convert the changing current into sound waves through the use of headphones or loud speakers at a remote station or listening post.

Figure 2:
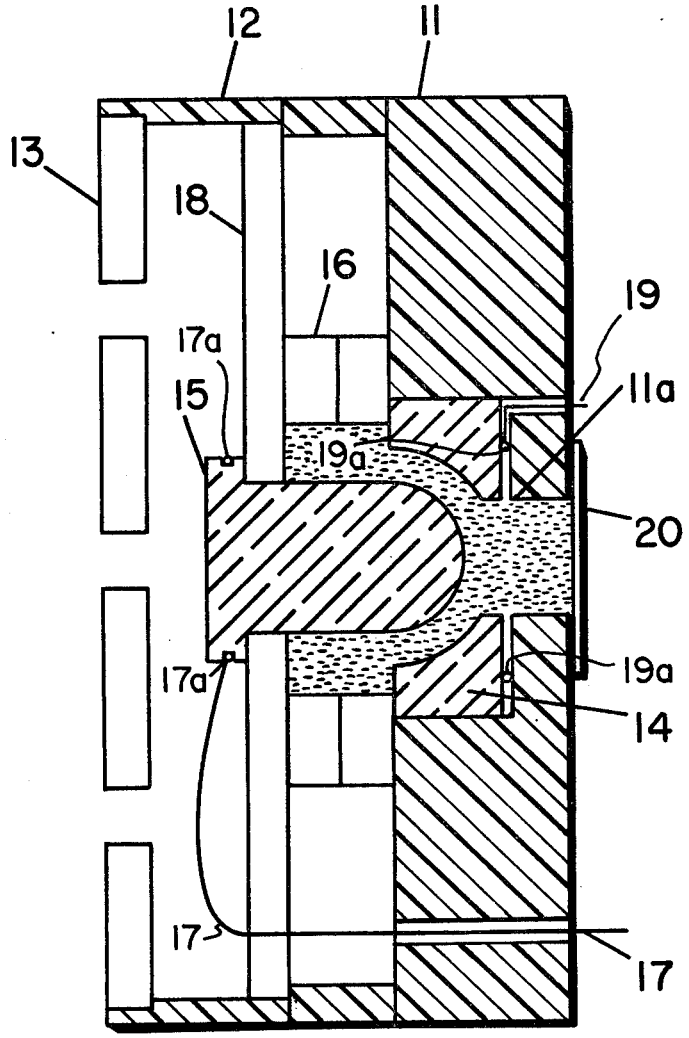
FIG. 2 is a cross-section of another embodiment of the invention using a flat diaphragm.

In FIG. 2, the device employs the same principles as that of FIG. 1, except that this device utilizes a flat non-metallic diaphragm 18 instead of the cone-shaped diaphragm of FIG. 1. In this embodiment, the carbon cup 14 together with a wire loop 19*a* geometrically positioned about the centrally located aperture therein is cemented in a central recess in the bottom of the case 11, with the aperture of the cup in alignment with the aperture 11*a*. A lead 19 is connected to wire loop 19*a*. The flat non-metallic diaphragm is spaced from the case bottom by means of soft, pliable retainer rings 16 and may have its periphery mounted on a shoulder of the case 11 as shown in FIG. 2. A carbon button is attached to the diaphragm and projects into the space formed by the retainer rings and carbon cup. A lead 17 is looped about and attached to the carbon button as shown.

As can be readily seen, the described construction forms a cavity between the carbon cup and button, the diaphragm 18 and rings 16 acting as retainers or closures for one end of the cavity. After filling with carbon granules the cavity is closed by means of the retainer 20. Leads 17 and 19 are utilized to connect the microphone to an external circuit.

The operation of FIG. 2 is substantially the same as the device in FIG. 1.

Thus it is readily seen that by using this new and simplified construction of non-metallic materials, there is provided a microphone which is similar in function to other single button carbon type microphones, but has no metallic parts except the lead wires connected to the carbon contacts.

Since many apparently differing embodiments of this invention will occur to one skilled in the art, it is obvious that various changes can be made in the specific details shown and described without departing from the spirit and scope of this invention. For example, the non-metallic case may be made in one integral unit or may have separate base and side members as shown by reference characters 1 and 2 in FIG. 1, or by reference characters 11 and 12 in FIG. 2. The diaphragm cover 3 of FIG. 1 may be interchanged with cover 13 of FIG. 2. Other non-metallic electrically conducting materials may be used for the electrodes (cup and button) and the compressible granules. Likewise, the flexible connecting leads may be made by using other techniques or materials, such as flexible high carbon paint.

What is claimed is:

1. A sound actuated device comprising a non-metallic cylindrical case having a closed end provided with a coaxial aperture extending therethrough, a carbon cup having a hemispherical recess with a coaxial aperture extending therethrough, a flexible wire loop, the said carbon cup being affixed within the said case in such manner that the apertures of both cup and case are in alignment with the said wire loop interposed between the abutting surfaces of the cup and the end of the case and disposed about the aperture, a carbon button of curvature complimentary to the recess of the said cup and in fixed aligned suspension therein, a flexible annular retainer concentrically secured to said carbon button and affixed to the radial outer surfaces of said carbon cup to maintain said button in said fixed aligned suspension, a first lead means passing through the said button along the central axis thereof and conductively affixed therein with the terminus thereof beyond the curved surface, carbon granules loosely distributed and contained between the said button, said cup and in the aperture of the said case, a non-metallic cone shaped diaphragm with the apex thereof attached to the center of the said carbon button and a second lead means connected to said wire loop; whereby sound induced vibrations on the diaphragm result in the reciprocal movements of the carbon button which in turn compresses and decompresses the carbon granules, thus inducing a variation of resistance between the first and second lead means.

2. A granular carbon microphone which includes a non-metallic case consisting of a hollow cylinder with a closed end, said closed end provided with a centrally located aperture extending therethrough, and a concentrically disposed annular recess on the inner wall surface thereof; a retainer positioned to seal said centrally located aperture; a cylindrical carbon cup secured within said annular recess, said cup provided with a substantially hemispherical axial bore and an aperture aligned with said first mentioned aperture; an elongated cylindrical carbon button with a hemispherical end portion movably positioned within said axial bore; a nonmetallic disc diaphragm secured at its outer periphery to the interior surface of said hollow cylinder, and affixed at its center to one end of said carbon button to exert force thereon; a pair of flexible annular retainer rings mounted between said diaphragm and said closed end of said cylinder, the inner bore of said rings being concentrically disposed with respect to said carbon button; and a plurality of carbon granules provided in the volume between said carbon button, said inner bore, said hemispherical axial bore of said carbon cup, and said retainer.

* * * * *